US008335447B2

(12) United States Patent
Maeda

(10) Patent No.: US 8,335,447 B2
(45) Date of Patent: Dec. 18, 2012

(54) FIXING DEVICE, IMAGE FORMING APPARATUS, FIXING DEVICE CONTROL METHOD, CONTROL PROGRAM AND RECORDING MEDIUM

(75) Inventor: Tomohiro Maeda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 466 days.

(21) Appl. No.: 12/634,217

(22) Filed: Dec. 9, 2009

(65) Prior Publication Data

US 2010/0172667 A1 Jul. 8, 2010

(30) Foreign Application Priority Data

Jan. 7, 2009 (JP) ..... 2009-001640

(51) Int. Cl.
*G03G 15/20* (2006.01)

(52) U.S. Cl. ..... 399/68; 399/336; 399/337

(58) Field of Classification Search ..... 399/67, 399/68, 122, 335–337
See application file for complete search history.

(56) References Cited

U.S. PATENT DOCUMENTS 7,529,495 B2 * 5/2009 Kachi ..... 399/69
2008/0101832 A1 * 5/2008 Yaoi et al. ..... 399/336

FOREIGN PATENT DOCUMENTS

JP 09-244439 9/1997
JP 11-038802 2/1999
JP 2005-055516 3/2005

* cited by examiner

*Primary Examiner* — Walter L Lindsay, Jr.
*Assistant Examiner* — Jessica L Eley
(74) *Attorney, Agent, or Firm* — Renner, Otto, Boisselle & Sklar, LLP

(57) ABSTRACT

A fixing device irradiates an unfixed toner image formed on the recording paper that is conveyed by an endless belt for conveying recording paper, with laser light so as to fuse the toner and fix the toner image. The fixing device includes a controller which makes such control as to convey the recording paper so as to pass through the position of the focal point of the laser light and bring the surface of the endless belt away from the position of the focal point of the laser light when conveyance of the recording paper is stopped.

6 Claims, 8 Drawing Sheets

FIXING DEVICE, IMAGE FORMING APPARATUS, FIXING DEVICE CONTROL METHOD, CONTROL PROGRAM AND RECORDING MEDIUM

This Nonprovisional application claims priority under 35 U.S.C. §119(a) on Patent Application No. 2009-001640 filed in Japan on 7 Jan. 2009, the entire contents of which are hereby incorporated by reference.

BACKGROUND OF THE INVENTION (1) Field of the Invention

The present invention relates to a fixing device and the like for fixing an unfixed toner image on recording paper that is conveyed by an endless belt for conveying recording paper, by fusing the toner by irradiation of laser light.

(2) Description of the Prior Art

Image forming apparatuses (e.g., printers, etc.) using electrophotography include a fixing device that thermally fuses the toner image formed on the paper to fix the toner image to the paper. As one example of the fixing device, a fixing device of a paired roller type made up of a fixing roller and a pressing roller has been known, as disclosed in patent document 1 (Japanese Patent Application Laid-open H11-038802).

The fixing roller is a roller member formed of a hollowed metal core made of aluminum or the like and an elastic layer formed on the surface thereof with a halogen lamp as a heater arranged inside the metal core. With this arrangement, a temperature controller makes on/off control of the halogen lamp in accordance with the signal output from a temperature sensor provided on the fixing roller surface so as to control the temperature on the fixing roller surface.

The pressing roller is a roller member made of a metal core and a heat-resistant elastic layer of silicone rubber etc., provided as a coating layer on the metal core. This pressing roller is put in press-contact with the peripheral side of the fixing roller so that the elastic layer of the pressing roller is elastically deformed forming a nip area between the fixing roller and the pressing roller.

In the fixing device having the above configuration, the paper with an unfixed toner image formed thereon is fed into the nip area between the fixing roller and the pressing roller and conveyed by rotating these two rollers while the toner image on the paper is fused by heat from the fixing roller surface and fixed to the paper.

However, in the conventional paired roller type configuration, since the fixing roller and the pressing roller should be put under a room temperature condition when the machine is activated first in the morning, the fixing device needs time to warm up to increase its temperature to the predetermined temperature from when the machine is activated. Further, in the waiting mode when no copying operation is performed, it is necessary to keep the roller surface at a predetermined temperature, hence heat the roller continuously even when no copying operation is performed. In this way, waste energy is consumed other than copying operations.

To deal with this, a method of fixing toner in an efficient manner without consumption of waste energy has been proposed in patent document 2 (Japanese Patent Application Laid-open 2005-55516) in which a fixing device fixes toner using laser power.

According to patent document 2, a plurality of low-power semiconductor lasers are used so that individual laser light rays emitted from the multiple laser light sources are focused and superimposed on the same area of the toner image, to thereby fuse and fix toner by making up for shortage of power.

This disclosure asserts that this configuration enables use of low-power inexpensive semiconductor lasers, hence can make the whole apparatus simple.

However, the above-described technology is effective in fixing unfixed toner images in a fair condition, but has the problem that the laser light from the fixing device is emitted wrong so that intensive laser light is radiated on and heats the recording paper conveyor, damaging the recording paper conveyor.

SUMMARY OF THE INVENTION

In view of the above problem, it is therefore an object of the present invention to provide a fixing device which can evade damage to the recording paper conveyor belt and hence damage to the image forming apparatus in case the fixing device causes trouble emission of laser light (intensive heating due to wrong emission of laser light).

In view of the above object, the first aspect of the present invention resides in a fixing device comprising: a controller that makes such control as to pass recording paper through the position of the focal point of laser light and bring the surface of an endless belt for conveying recording paper away from the position of the focal point of the laser light when conveyance of the recording paper is stopped, characterized in that an unfixed toner image formed on the recording paper that is conveyed by the endless belt is irradiated with laser light so as to fuse the toner and fix the toner image.

The second aspect of the present invention is characterized in that the controller makes such control as to bring the conveyor surface away from the position of the focal point of the laser light, based on the detection signal obtained by a photo detector detecting the reflected light of the laser light that is radiated on the recording paper conveyor surface of the endless belt.

The third aspect of the present invention is characterized in that the controller changes the intensity of laser irradiation between when the unfixed toner image is fixed and when the position of the recording paper conveyor surface of the endless belt is detected.

The fourth aspect of the present invention is characterized by comprising a movable part for moving the endless belt in a vertical direction.

The fifth aspect of the present invention is characterized in that an image forming apparatus includes the above-described fixing device.

The sixth aspect of the present invention resides in a control program for operating the above-described fixing devise, to cause a computer to function as the controller.

The seventh aspect of the present invention resides in a computer-readable recording medium on which the above-described control program is recorded.

The eighth aspect of the present invention resides in a control method of a fixing device that includes: a laser light emitter for fixing an unfixed toner image; a recording paper conveyor for conveying recording paper by means of an endless belt; a movable part for moving the recording paper conveyor in a vertical direction; and, a photo detector for detecting the surface position of the recording paper and the surface position of the endless belt by use of the reflected light of the laser light, wherein the movable part is controlled based on the detected result from the photo detector.

According to the present invention, when an unfixed toner image passes through the irradiated position of laser light, the surface of the endless belt on the recording paper conveyor is positioned so as to coincide with the position of the focal point of the laser light, whereby it is possible to efficiently heat the toner. On the other hand, in case the laser light has got out of control due to some trouble during a cessation of the conveying operation, the recording paper can be shifted away from the position of the focal point of laser light, whereby it is possible to prevent the recording paper conveyor from being intensively heated and hence being damaged.

Also, based on the detection signal from the photo detector which detects the reflected light of the laser light, the recording paper conveyor surface of the endless belt can be moved away from the position of the focal point of the laser light. For example, when the endless belt is irradiated with laser light, the received light intensity of the reflected light detected by the photo detector is monitored so as to determine whether the received light intensity Q1 is equal to or greater than threshold Q0 (here, Q0 is the received light intensity at the photo detector when the conveyor surface of the endless belt is set at the position of the focal point of the laser). The received light intensity at the photo detector when the conveyor surface of the endless belt set at the position of the focal point of the laser, becomes greater compared to that when the conveyor surface is set off the position of the focal point, so that a value equal to or greater than Q0 can be detected at the photo detector. On the other hand, when the detected signal Q1 is less than Q0, this detection is used to determine that the conveyor surface is deviated from the position of the focal point. With this scheme, it is possible to control the position of the focal point using the fixing laser light.

The control described above enables a single laser device to be used for two different tasks, namely as the laser for fixing and as the laser for adjusting the position of the focal point. Further, since the recording paper conveyor is set off the position of the focal point at the time other than when the paper is passed therethrough, even if the laser light has got out of control due to some unspecified trouble, and the laser emitter, getting out of order, gives off a radiation of laser, the recording paper conveyor can be prevented from being intensively heated and hence being damaged.

Further, it is possible to change the intensity of laser irradiation between when the unfixed toner image is fixed and when the position of the recording paper conveyor surface of the endless belt is detected. For example, the intensity of irradiation with the laser used to detect the position of the recording paper conveyor surface of the endless belt is set at a low level while the intensity of irradiation for fixing operation is set a high level since it is necessary to give off high enough energy to fuse the toner. In this way, differentiating the intensity enables limited use of the necessary amount of energy, hence making it possible to cut down consumption of energy.

Further, the recording paper conveyor is constructed so that the endless belt can be moved in a vertical direction. That is, rotation of an eccentric cam (movable part) to move the recording paper conveyor in a vertical direction relative to the light irradiation surface, makes it easy to shift the surface of the recording paper conveyor from the position of the focal point of the laser light.

Further, the controller is able to read the method of controlling the recording paper conveyor by comparing the reflected light detected by the photo detector with the predetermined set value, and execute the read method, hence it is possible to make this control method versatile.

DESCRIPTION OF THE PREFERRED EMBODIMENTS

Figure 1:
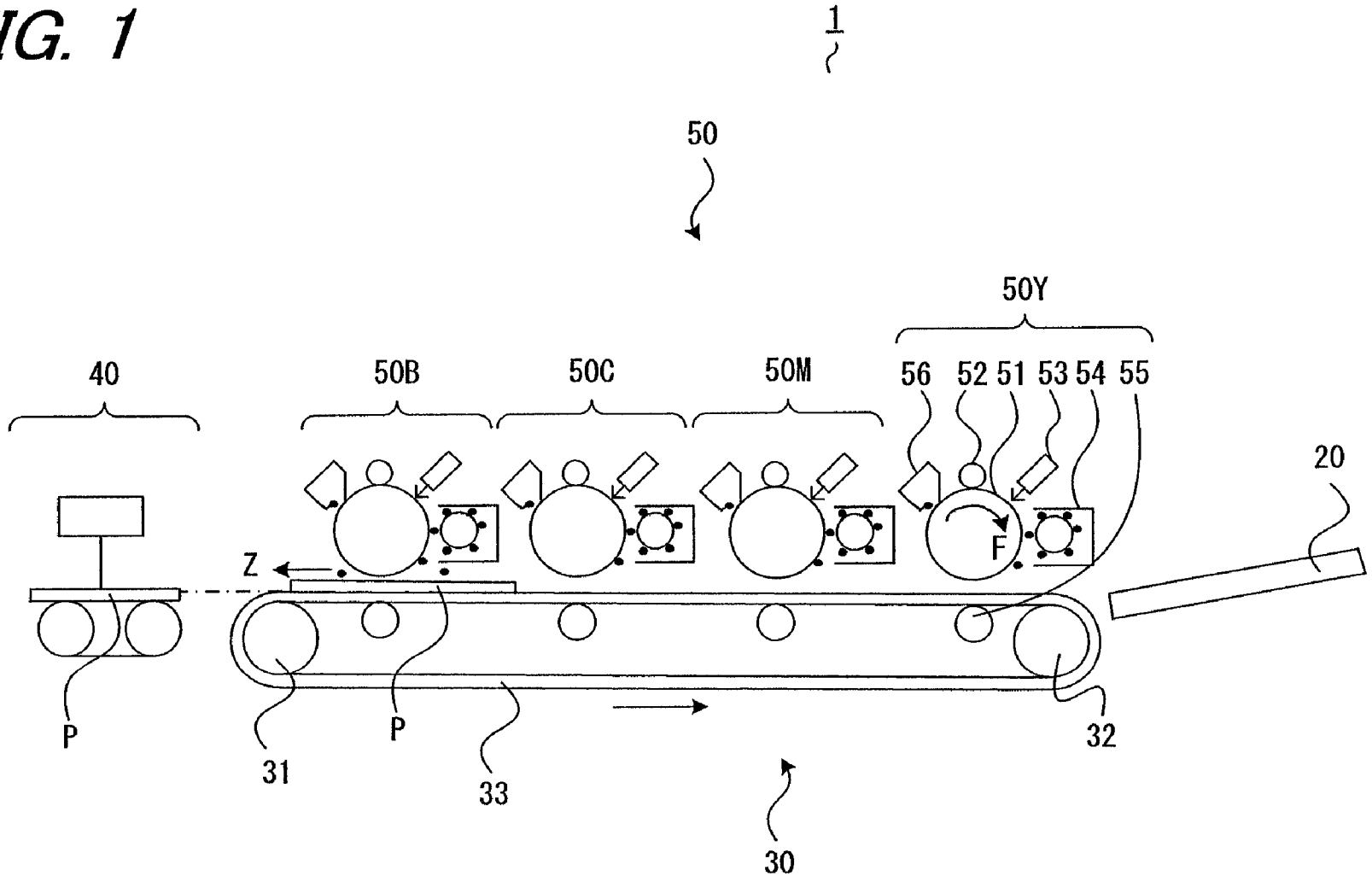
FIG. 1 is a diagram for illustrating the machine layout of an image forming apparatus in the present embodiment.

The preferred embodiment of the present invention will hereinafter be described in detail with reference to the accompanying drawings. Here, in the specification and drawings, the components having substantially the same functions are allotted with the same reference numerals, and repeated description is omitted.

[Apparatus Configuration]

To begin with, the configuration of an image forming apparatus 1 to which the fixing device of the present invention is applied will be described with reference to the drawings.

FIG. 1 shows the interior configuration of a dry type electrophotographic color image forming apparatus. Image forming apparatus 1 forms a multi-color or monochrome image on a predetermined recording medium (recording paper) in accordance with image data or the like transmitted from a terminal device on the network.

Image forming apparatus 1 includes visual image forming units 50 (50Y, 50M, 50C and 50B), a recording paper conveyor 30, a fixing device 40 and a paper feed tray 20.

This image forming apparatus 1 has four visual image forming units 50Y, 50M, 50C and 50B arranged in parallel, corresponding to different colors, i.e., yellow (Y), magenta (M), cyan (C) and black (B). That is, visual image forming unit 50Y performs image forming with yellow (Y) toner, visual image forming unit 50M performs image forming with magenta (M) toner and visual image forming unit 50C performs image forming with cyan (C) toner, and visual image forming unit 50B performs image forming with black (B) toner. As a specific layout, four visual image forming units 50 are arranged in a so-called tandem manner along the conveying passage of recording paper that connects between paper feed tray 20 of recording paper P and fixing device 40.

Visual image forming units 50Y, 50M, 50C and 50B have substantially the same configurations. That is, visual image forming units 50Y, 50M, 50C and 50B each include a photoreceptor drum 51, a charger 52, a laser light emitter 53 (herein, the laser light emitter for writing a latent image on the photoreceptor drum), a developing unit 54, a transfer roller 55 and a cleaner unit 56, and each transfer toner of a corresponding color to recording paper P being conveyed, one over the other.

Here, the photoreceptor drum 51 is a component that supports an image to be formed.

Charger 52 is a component that uniformly electrifies the photoreceptor drum 51 surface at a predetermined potential.

Laser light emitter 53 illuminates the photoreceptor drum 51 surface that has been electrified by charger 52, in accordance with the image data supplied to the image forming apparatus to form an electrostatic latent image on the photoreceptor drum 51 surface.

Developing unit 54 visualizes the electrostatic latent image formed on the photoreceptor drum 51 surface with the toner of a corresponding color.

Transfer roller 55 is applied with a bias voltage that is opposite to the polarity of the toner to transfer the formed toner image to recording paper P that is conveyed by means of an aftermentioned recording paper conveyor 30.

Drum cleaner unit 56 removes and collects the toner that remains on the photoreceptor drum 51 surface after development by developing unit 54 and transfer of the formed image from photoreceptor drum 51.

Transfer of the toner image to recording paper P as in the above is performed for every color, so four times of transfer are repeated.

Recording paper conveyor 30 includes a drive roller 31, an idling roller 32 and a conveyor belt 33 to convey recording paper P so that a toner image is completed on recording paper P through visual image forming units 50.

Drive roller 31 and idling roller 32 support and tension endless conveyor belt 33 therebetween. Drive roller 31 is controlled to turn at a predetermined peripheral speed so as to circulate the endless conveyor belt 33.

Conveyor belt 33 carries electrostatic charge on the outer surface thereof so as to convey paper P by electrostatically attracting the paper P thereto.

As being conveyed by conveyor belt 33 in the above way, the recording paper P has the toner image transferred thereto, then is peeled off from conveyor belt 33 due to the curvature of drive roller 31 and delivered to fixing device 40.

Fixing device 40 gives appropriate heat to recording paper P so as to fuse the toner and fix the toner image to the recording paper, forming a robust image.

Figure 2:
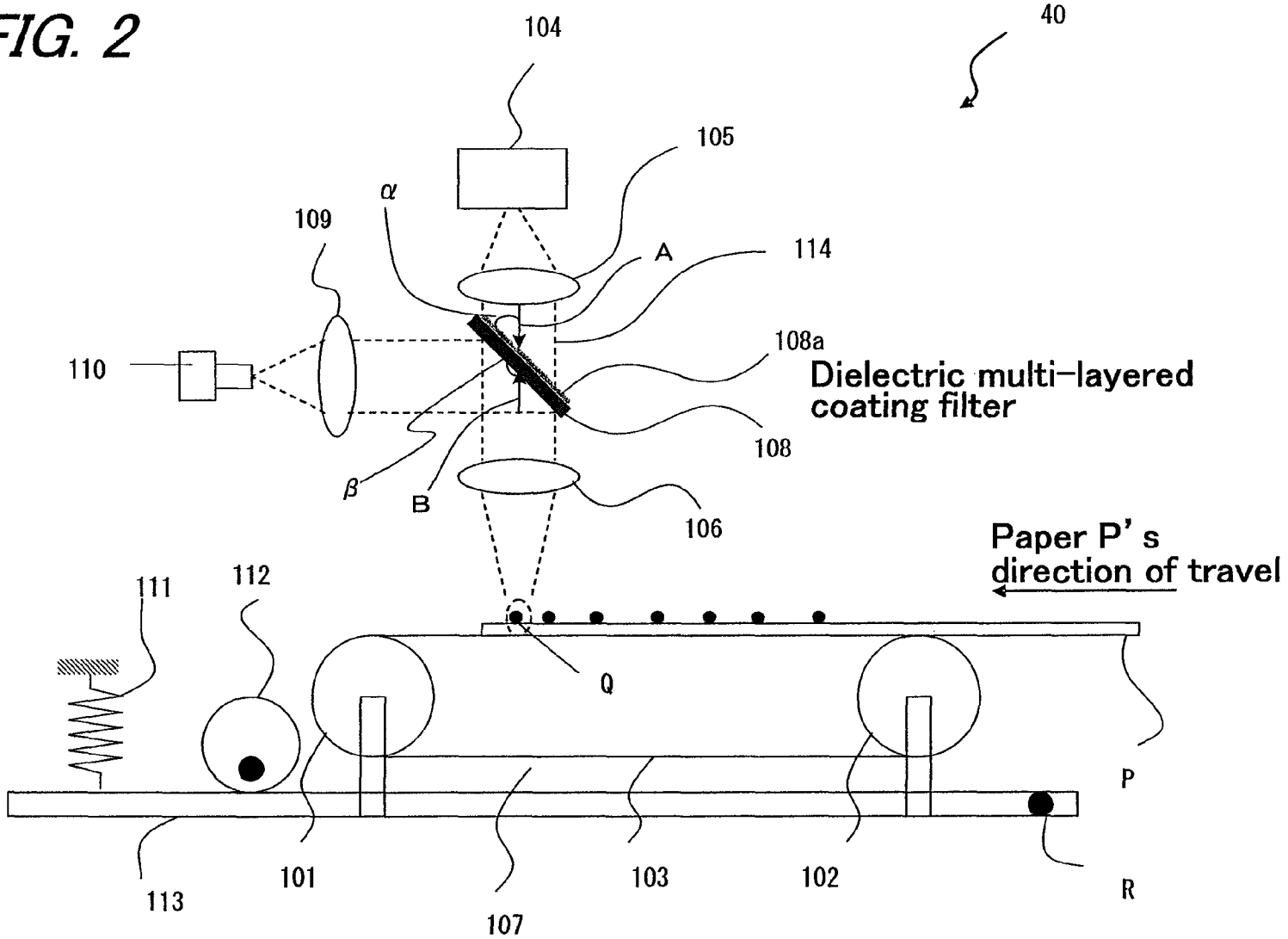
FIG. 2 is a diagram for illustrating the device configuration of a fixing device according to the present embodiment.

Now, fixing device 40 will be described in detail with reference to FIG. 2.

Fixing device 40 includes a laser light emitter (light source) 104 and a recording paper conveyor 107 for conveying recording paper P.

Recording paper conveyor 107 includes two tension rollers 101 and 102 and a heat-resistant endless belt 103 as a recording paper conveyor belt. Recording paper P is conveyed over endless belt 103.

Two tension rollers 101 and 102 are each arranged with their axes supported by bearings (not shown). Tension roller 101 is coupled with a first driver (not shown) via an unillustrated gear.

Further, the aforementioned bearings are both connected to an arm 113.

Arm 113 is arranged so that its one end on the upstream side with respect to the paper P's direction of travel is supported at a pivot R while the other end on the downstream side with respect to the paper P's direction of travel is supported by a spring 111.

Arm 113 is constantly put in pressing contact with an eccentric cam 112 (movable part) by the restoring force of spring 111.

Pivot R is arranged a predetermined distance away, to the upstream side with respect to the paper P's direction of travel from the upstream side tension roller 102, and downward from tension roller 102.

Spring 111 is arranged a predetermined distance away, to the downstream side with respect to the paper P's direction of travel from the downstream side tension roller 101. Spring 111 can be attached at any position as long as the spring can give restoring force to arm 113.

Eccentric cam 112 is arranged between the downstream side tension roller 101 and spring 111 but may be arranged at any position as long as arm 113 can be swayed.

As eccentric cam 112 rotates, recording paper conveyor 107 that is coupled with arm 113 moves vertically about pivot R so as to be able to vary the position of the belt surface. By changing the position of the belt surface, it is possible to place, and displace, the position of the recording paper surface to, or from, the position of the focal point of the laser light from laser light emitter 104.

Accordingly, before entrance of the paper to, or after passage of the paper from, fixing device 40, eccentric cam 112 is controlled to turn so that the focal point, designated at Q, of the laser light does not coincide with the conveying surface of recording paper conveyor 107 for recording paper P, while during passage of the paper through fixing device 40, eccentric cam 112 is controlled to turn so that focal point Q of the laser light coincides with the unfixed image formed on the surface of recording paper P, whereby it is possible to prevent occurrence of damage to recording paper conveyor 107 (e.g., endless belt 103) even if laser light emitter 104 gives off light (wrong emission of light) during the period other than passage of the paper.

Eccentric cam 112 is coupled with a second driver (not shown). The second driver turns ON and OFF of the rotation thereof in accordance with the signals for start of paper passage and end of paper passage, sent from a controller 600 (e.g., CPU, see FIG. 5). Description as to FIG. 5 will be given later.

Laser light emitted from laser light emitter 104 is collimated by a lens 105 from spread rays into parallel rays, and the thus collimated light is converged at the position of focal point Q by a lens 106. That is, the light energy of the laser light emitted from laser light emitter 104 concentrates at the position of focal point Q. Here, the broken line designated at 114 shows the optical path of the laser light emitted from laser light emitter 104. During the paper is passing through fixing device 40, the rotational position of eccentric cam 112 is controlled so that focal point Q coincides with the paper surface.

Detection of the surface position of recording paper P is made by sensing the reflected light from the recording paper with a photo detector 110 (description of photodetector 110 will be described later) when the laser light from laser light emitter 104 is radiated thereon. That is, based on the detected signal from photodetector 110, a fixing controller 612 (see FIG. 5) controls the position of recording paper conveyor 107 (rotation of eccentric cam 112) to thereby make the paper surface coincide the position of focal point Q.

For example, when the recording paper surface coincides with the position of focal point Q, optical path 114 is concentrated on photo detector 110. Specifically, as shown in FIG. 2, light emitted from laser light emitter 104 is reflected off the position of focal point Q, and the reflected light is reflected off a half-mirror 108 (half-mirror 108 will be described later) toward photodetector 110. The light after condensation of a lens 109 is detected by photo detector 110. When this detected signal takes the maximum value, the position of focal point Q and the recording paper surface position coincide. On the other hand, when the focal point is out of place, the detected signal takes a value lower than that detected by photo detector 110 when the light is in focus. This is determined to be the case that the focal point is located out of place.

Figure 4:
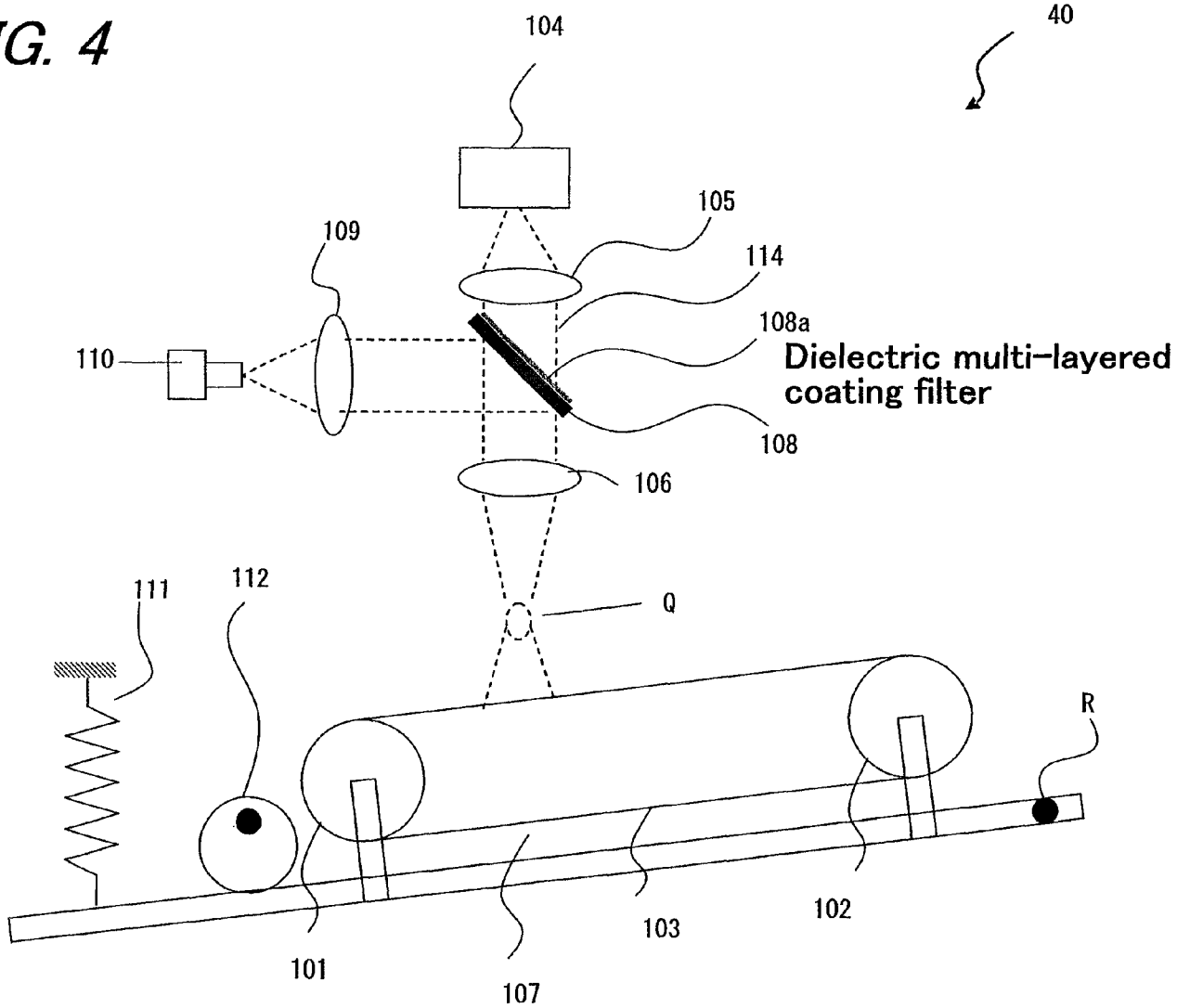
FIG. 4 is a diagram for illustrating the device configuration of a fixing device according to the present embodiment.

For example, when the position of focal point Q does not coincide with the conveyor surface of endless belt 103 as shown in FIG. 4, the reflected light that passes through lens 106 is weak, hence the intensity of light converged by lens 109 is low. In this way, the positional relationship between the position of focal point Q and the belt surface can be controlled based on the received light intensity at photo detector 110. When the fixing device 40 is unoperated, control is made such that the conveyor surface of endless belt 103 for recording paper P is adapted to be shifted from the position of focal point Q of laser light emitter 104. With this arrangement, even if the laser light has got out of control due to some trouble and the laser continues to radiate getting out of order, the recording paper conveyor belt or endless belt 103 will not be heated intensively because the position of focal point Q is located off endless belt 103. Hence it is possible to prevent endless belt 103 from being damaged.

Next, photo detector 110 will be described.

Photo detector 110 used in the present embodiment may employ a CCD sensor or CMOS sensor.

A CCD is a kind of a semiconductor device having a MOS structure, in which a large number of electrodes are formed on the oxide film on the surface of a silicon substrate and different voltages are applied to adjacent electrodes to create potential wells to thereby retain electric charges using the potential wells.

There are two classes of structures, namely one-dimensional image sensors and two-dimensional image sensors.

The one-dimensional image sensor can also be called linear image sensor, which includes a row of photodiodes and a row of CCD elements arranged in parallel. The electric charge that has been obtained from photoelectric conversion by every photo diode at one time of exposure is, all at once, transferred to the CCD element corresponding to each pixel, then transfer pulses are applied to the CCD elements so as to read the charge sequentially. When the charge of all the pixels has been output, then the next exposure is enabled. Since the one-dimensional image sensor can implement photoelectric conversion of a linear image only, the image sensor is moved relatively to the subject or an equivalent relative movement by optical system is produced to cover the subject as a whole. This is the mechanism that is used for facsimile machines, copiers, image scanners, and the like.

The two-dimensional image sensor is also called area image sensor. The interline CCD image sensor having an interline architecture, which is often used for usual video cameras and digital cameras, has a configuration in which rows of photodiodes as photo receivers and rows of vertical transfer CCD elements as charge transfer portions are arranged every other line while the end of each vertical CCD row is connected to each horizontal transfer CCD element to form a comb-like structure as a whole. Each transfer CCD is covered with a shading film so as not to perform photoelectric conversion. Further, a transfer gate that operates as an analog switch is disposed between the photodiode for each pixel and the vertical CCD element corresponding to the pixel.

A CMOS sensor has a characteristic such that generation of electric noise due to reading of the photoelectrically converted electric signal can be suppressed because every unit cell has an amplifier. Further, since the CMOS sensor can be mass produced by application of the CMOS logic LSI manufacturing process, the CMOS sensor is less expensive compared to a CCD image sensor having high-voltage analog circuitry, and further has the advantage that power consumption is low because the device is small, and no smear and blooming will occur in principle.

Figure 5:
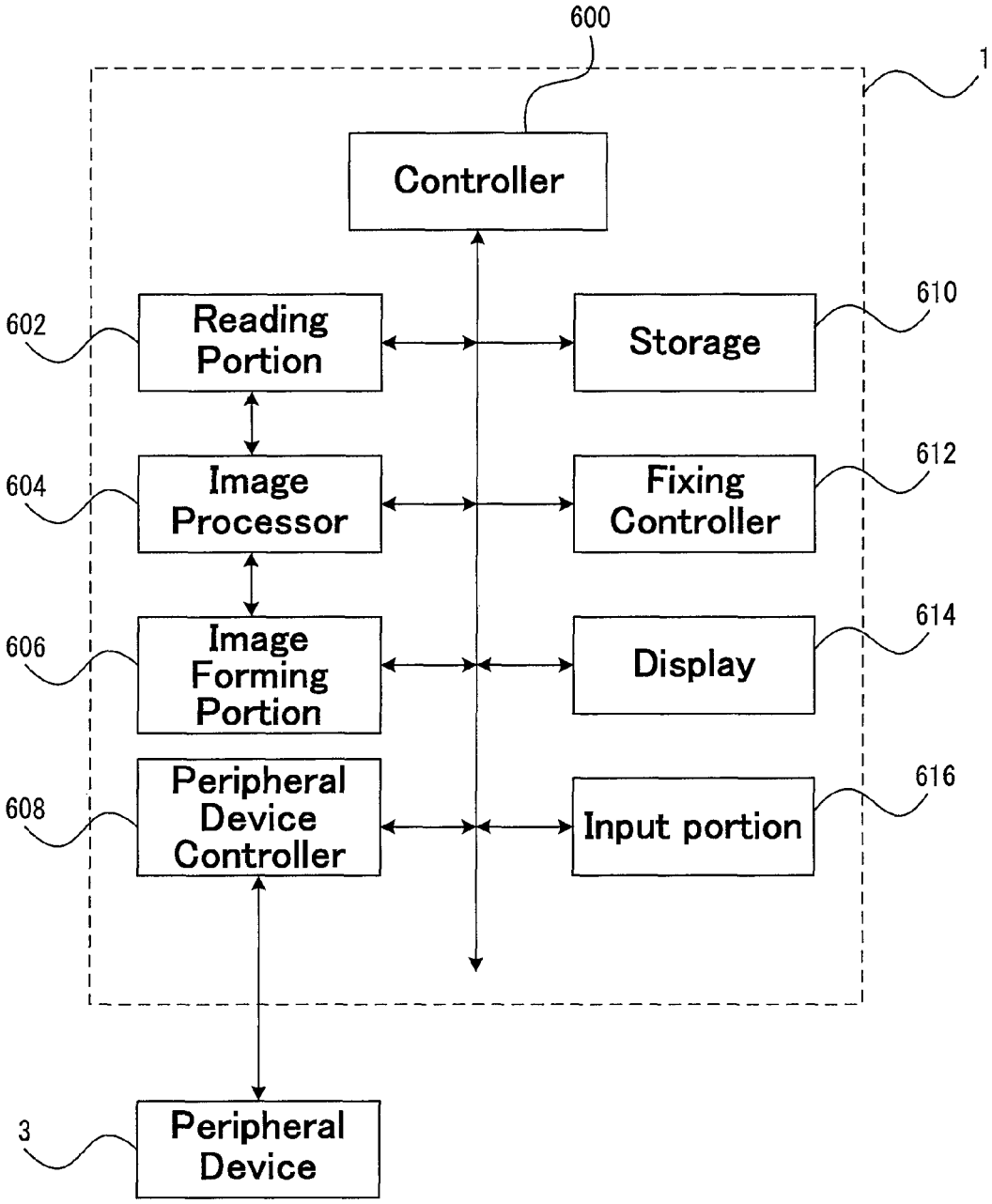
FIG. 5 is a diagram for illustrating the functional configuration of an image forming apparatus according to the present embodiment.

The present embodiment will be described taking an example where an interline CCD image sensor having an interline structure is applied. An interline CCD image sensor is configured of two-dimensionally arrayed photodiodes, vertical CCD registers, a horizontal CCD registers and an output amplifier. The photodiodes receive reflected light B (see FIG. 2), and the signal charge that has been photoelectrically converted from reflected light B is transported through the vertical CCD registers to the horizontal CCD register, and then converted to voltage by the output amplifier. The thus obtained signal in the form of a voltage signal is sent to fixing controller 612 (FIG. 5).

Fixing controller 612 transmits the received voltage signal to a controller 600. Controller 600 determines the position of the recording paper by comparison with the data on the focal point for recording paper P, previously stored in a storage 610.

Accordingly, when the current position does not coincide with the focal point for recording paper P that is previously stored, fixing controller 612 further rotates eccentric cam 112 so that recording paper P is positioned to the focal point. Here, since determination of the position of the focal point on the recording paper conveyor surface of endless belt 103 is equivalent to the above-described determination of the focal point on recording paper P, description is omitted.

In this connection, the interline CCD image sensor may use a CCD image sensor manufactured by Fairchild Imaging, for example.

Subsequently, half mirror 108 (FIGS. 2 and 4) will be described.

An ordinary mirror is produced by applying reflecting metal film over a glass plate or the like. Since this reflecting film reflects incoming light in a fairly good manner, the mirror can reflect light or scenes around it.

In producing a reflection coating on half mirror 108 a very thin film is formed by performing vapor deposition or the like. This provides a light transmitting property for the reflecting film, so that the incoming light of some strong intensity, when it is incident on the rear side, can transmit through the film to the front side.

There are some different half mirror structures, including a metal half mirror which is formed by applying a markedly thin reflecting metal coating when producing the mirror, a dielectric half mirror which is formed by laminating multiple markedly thin coatings of two or more kinds of substances as the reflecting layer, and others.

The half mirror used in the present embodiment uses one that is called a beam splitter, which can shift the phase of light. This is generally called dielectric multi-layered coating filter (mirror), which changes the phase angles to be given to the transmitted light and the reflected right. For example, in half mirror 108 used in FIG. 2, the incident light A enters the mirror with an incident angle $\alpha$ of 45 degrees while the reflected light B is reflected with a reflection angle $\beta$ of 135 degrees.

In dielectric multi-layered coating filter (half mirror 108 of the present embodiment), dielectric multi-layered coatings are formed on the surface of a glass substrate that opposes laser light emitter 104, with material that transmits a light of 780 nm with an incident angle $\alpha$ of 45 degrees and reflects the light with a reflection angle $\beta$ of 135 degrees.

Typical examples of the material used include $LaF_3$, $Al_2O_3$, complex oxide of $Pr_2O_3$ and $Al_2O_3$, complex oxide of $La_2O_3$ and $Al_2O_3$, $Bi_2O_3$, SiO, $Ta_2O_5$ and the like. Accordingly, even if half mirror 108 is disposed in optical path 114, incident light A can pass therethrough while reflected light B can propagate toward the photo detector.

Figure 3:
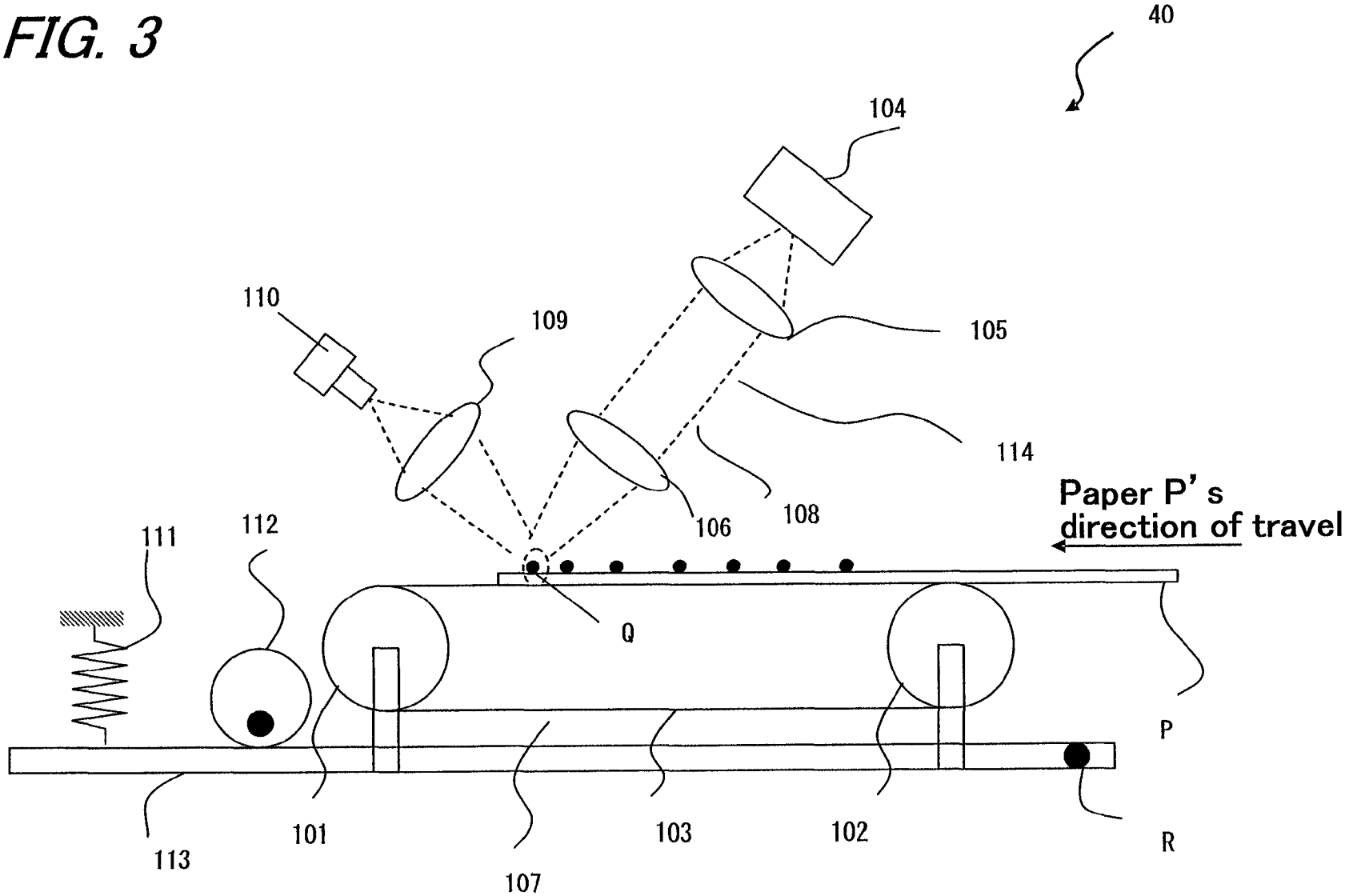
FIG. 3 is a diagram for illustrating the device configuration of a fixing device according to the present embodiment.

FIG. 3 shows a fixing device that does not use half mirror 108. Laser light emitter 104 radiates laser light on the paper surface of recording paper P with an angle of 45 degrees from the right in the drawing and the reflected right is emitted towards photo detector 110 from the paper surface of recording paper P with a reflection angle of 45 degrees from the left in the drawing. Details other than these are the same as in FIG. 2, so description is omitted.

[Functional Configuration]

Referring next to FIG. 5, the functional configuration of image forming apparatus 1 will be described.

Image forming apparatus 1 is a multifunctional machine or the like including a scanner and a printer, for example, and may be connected with a peripheral device 3. Image forming apparatus 1 includes controller 600, a reading portion 602, an image processor 604, an image forming portion 606, a peripheral device controller 608, storage 610, fixing controller 612, a display 614 and an input portion 616, all being connected by the bus.

Reading portion 602 is made up of a scanner and the like to read images of documents.

Image processor 604 converts the electric signals of images read from documents by reading portion 602 into image data.

Image forming portion 606 produces printout of the image data supplied from image processor 604.

Peripheral device controller 608 is a functional part for controlling peripheral device 3 such as a finisher, sorter or the like that is connected to image forming apparatus 1.

Peripheral device 3 is connected with image forming apparatus 1 through a dedicated bus but may be connected through a multi-purpose interface such as USB or the like.

Storage 610 is a functional part for storing the necessary programs, data and the like to operate image forming apparatus 1. For example, the storage is made up of semiconductor memory devices, magnetic disks such as HDDs etc., and the like.

Fixing controller 612 is a functional part for controlling the laser light emission of the aforementioned laser light emitter 104 and the drive of fixing device 40. For example, the controller, receiving control signals, controls rotation of the first driver of tension roller 101 and the second driver of eccentric cam 112, and controls laser light emission of laser light emitter 104.

Display 614 is a functional part for displaying various pieces of information to the user, and input portion 616 is a functional part for receiving control input from the user. Display 614 is comprised of a liquid crystal display, an organic E1 panel or the like, for example. Input portion 616 is comprised of, for example control keys, a touch panel and the like.

Control portion 600 is a functional part for controlling image forming apparatus 1 and is comprised of a processor such as a CPU or the like, for example. Controller 600 realizes different functions by reading and executing different programs stored in storage 610.

Controller 600 transmits information on printing position (signals that indicate where printing will be done in every page for a print job) of the image information (image data) received from image processor 604, to fixing controller 612.

Fixing controller 612, based on the rotation starting signals for the first driver for tension roller 101 and the second driver for eccentric cam 112 and the information on printing position, which are received from controller 600, drives laser light emitter 104 to control irradiation of laser light.

Further, controller 600 determines start of printing based on the aforementioned information on printing position and controls circulation of the belt by the first driver in recording paper conveyor 107 and controls rotation of eccentric cam 112 by the second driver.

[Processing Flow]

Next, the processing flow of a process associated with a copying operation in image forming apparatus 1 will be described using the flowchart shown in FIGS. 6, 7 and 8. Here, it goes without saying that if the user gives print instructions from the window of the printer driver, the control based on this flow chart can be executed in accordance with the signal of the user's print instructions.

Herein, the description as follows is made on the assumption that the document the user wants to copy has been set on the scanner or has been put on the document table.

When the user presses the copy key in input portion 616, controller 600 receives the user's press-down signal (print command signal) and makes such control that reading portion 602 of the scanner, for example, reads the document image and image processor 604 executes image processing of the read signal, and receives the print command signal (the signal for starting a printing operation or starting a copying operation).

Figure 6:
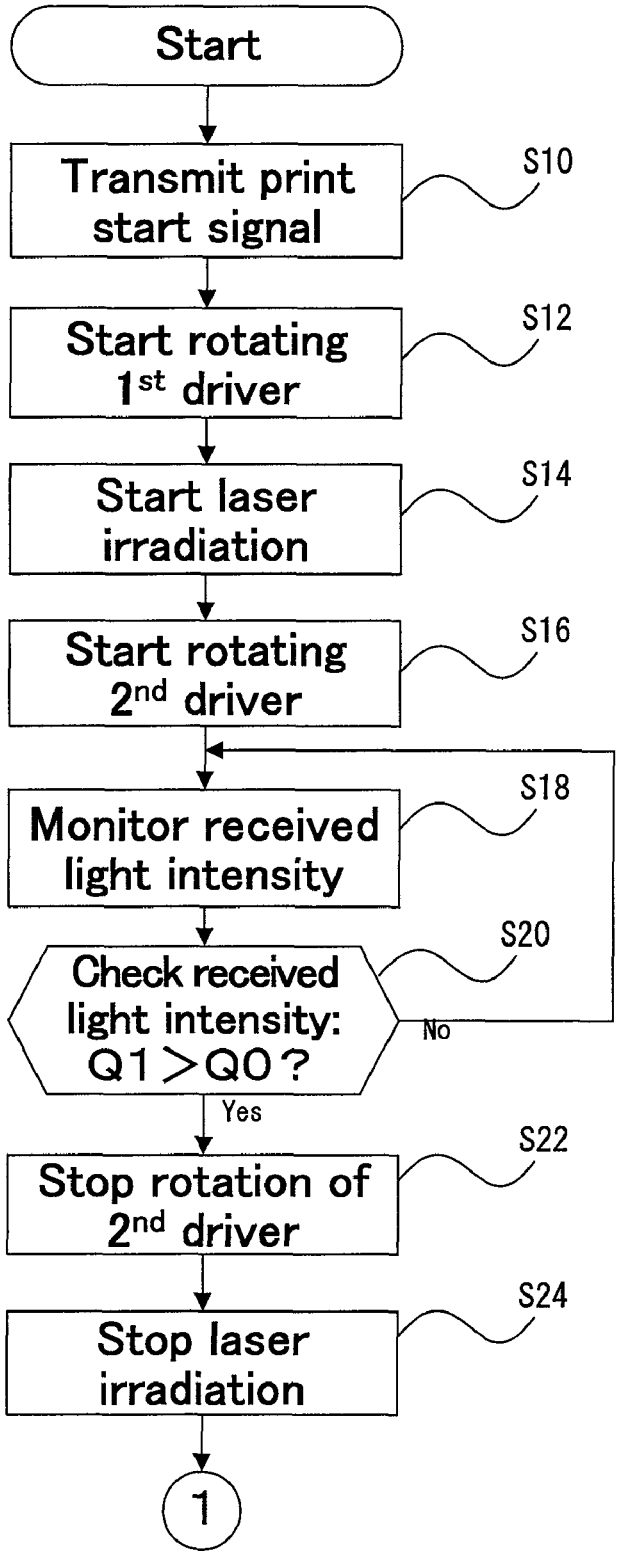
FIG. 6 is an operational flow chart for illustrating the process of an image forming apparatus of the present embodiment.
Figure 7:
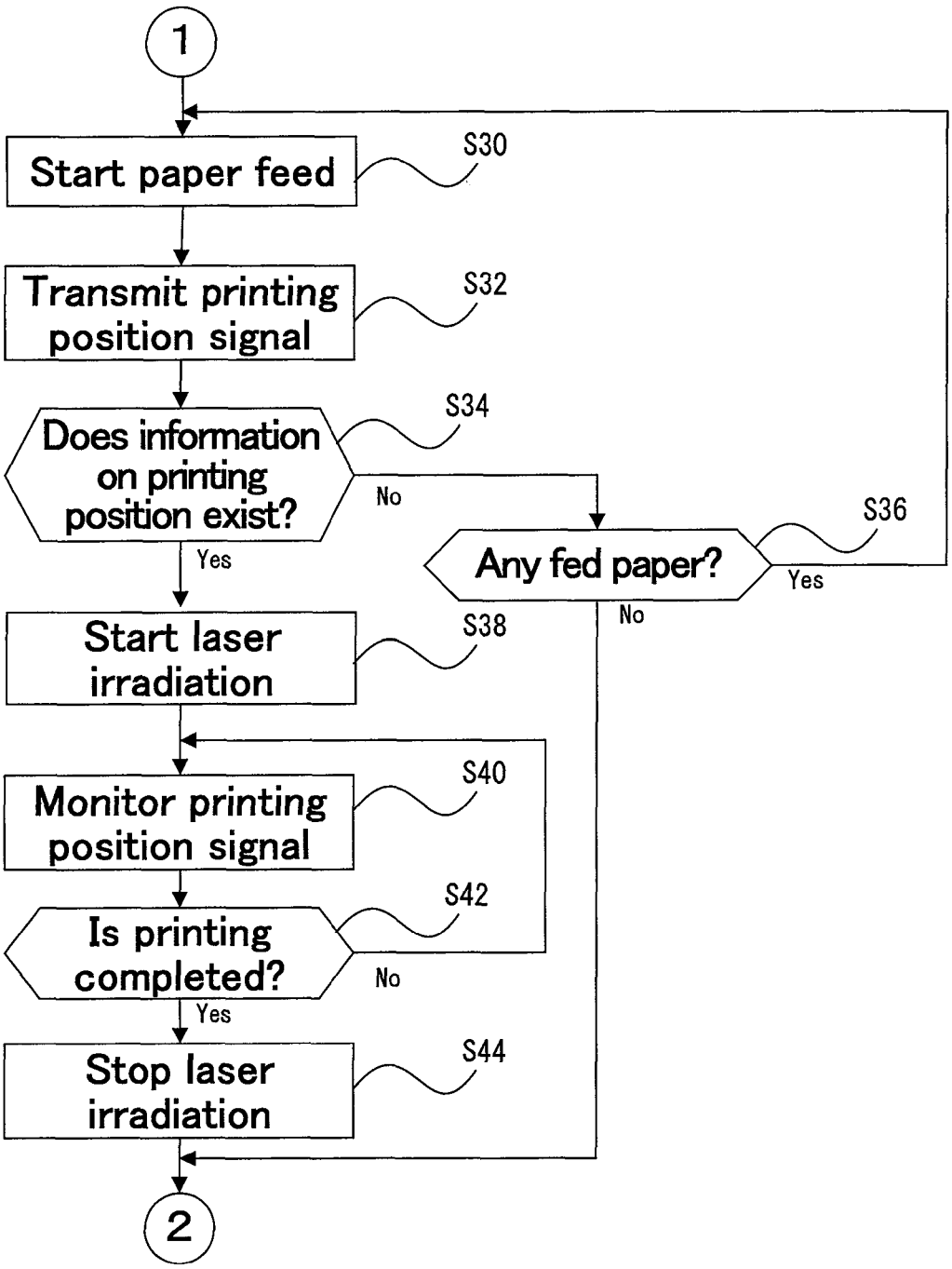
FIG. 7 is an operational flow chart for illustrating the process of an image forming apparatus of the present embodiment; and, FIG. 8 is an operational flow chart for illustrating the process of an image forming apparatus of the present embodiment.

Controller 600, based on the received print command signal, transmits a printing start signal to fixing controller 612 (Step S10 in FIG. 6).

Fixing controller 612 starts rotating the first driver of tension roller 101 (Step S12). Fixing controller 612 also transmits a laser light output signal to laser light emitter 104 so as to control start of irradiation with laser light.

Next, fixing controller 612 starts rotating the second driver of eccentric cam 112 (Step S16). Here, fixing controller 612 makes control such as to move the conveyor surface of endless belt 103 in the vertical direction by rotating eccentric cam 112 coupled to the second driver until the received light intensity Q1 at photo detector 110 that receives the light of the laser light emitted from laser light emitter 104 and reflected on the conveyor surface of endless belt 103 becomes greater than a threshold Q0. Specifically, laser light emitter 104 irradiates the conveyor surface of endless belt 103 with laser light and fixing controller 612 monitors the received light intensity at photo detector 110 for detecting the reflected light (Step S18), and controller 600 determines whether this received light intensity Q1 is equal to or greater than threshold Q0 (Step S20).

Here, threshold Q0 is the received light intensity at photo detector 110 when the conveyor surface of recording paper conveyor 107 is located at the position of the focal point, but threshold Q0 may be set arbitrarily. For example, when the received light intensity at photo detector 110 has become lowered due to abrasion, soil and the like of endless belt 103 even though the conveyor surface is positioned at the focal point, controller 600 is able to adjust threshold Q0 based on the set value previously stored in storage 610. It is, however, noted that threshold Q0 needs to be set at such a value as to detect the difference in received light intensity between when the focal point coincides with the conveyor surface and when the focal point does not.

The received light intensity at photo detector 110 when the conveyor surface of recording paper conveyor 107 coincides with the position of the focal point will be greater than that when the focal point does not coincide with the conveyor surface, and can take a value equal to or greater than threshold Q0.

On the other hand, when a detected signal Q1 detected by photo detector 110 is lower than threshold Q0, the conveyor surface is regarded to be off the position of the focal point, so that eccentric cam 112 is continued to rotate in order to adjust the position of the focal point.

When the received light intensity at photo detector 110 is equal to or greater than threshold Q0, controller 600 transmits a signal that stops rotation of the second driver of eccentric cam 112 to fixing controller 612 (Step S22), and fixing controller 612 stops radiation of the laser light from laser light emitter 104 (Step S24).

Subsequently, controller 600 starts paper feed to fixing device 40 (Step S30 in FIG. 7). In this stage, when a printing position signal (signal indicating print size (paper), printing area (margin) and information on printing position (dot geometry)) is transmitted to fixing controller 612 (Step S32), it is determined whether there is information on printing position (Step S34).

If there is no information on printing position (Step S34; No), it is determined whether there exists a fed paper (Step S36). If there exists a fed paper (Step S36; Yes), the control goes to the process at Step S30. If there exists no fed paper (Step S36; No), the control goes to the process at Step S50.

On the other hand, when it is determined that there exists information on printing position at Step S34 (Step S34; Yes), fixing controller 612 makes control such as to start laser light emitter 104 to radiate laser light (Step S38). Herein, when the laser light emitter 104 outputs laser light, the intensity of irradiation when the laser light is focused on the conveyor surface of recording paper conveyor 107 (at the time of focusing control) is differentiated from the intensity of irradiation when the laser light is irradiated (on the recording medium for fixing in the printing operation on the paper) in accordance with the print command signal (at the time of fixing). Differentiating the intensity of irradiation between at the time of focusing control and at the time of fixing enables use of the necessary amount of energy only, hence making it possible to reduce consumption of energy.

Next, in order to stop radiation of laser light from laser light emitter 104, the printing position signal is monitored (Step S40). When the printing position signal stops giving information on printing position, it is determined that printing is ended (Step S42; Yes) and the radiation of laser light is stopped (Step S44).

It was assumed in this flow chart that the control to stop the radiation of laser light is monitored by fixing controller 612. That is, movement of recording paper P is monitored in association with the movement of endless belt 103. For example, the motor signal for driving endless belt 103 and the signal of the actuator for detecting the conveyance of recording paper P are monitored. It is also possible to estimate the arrival time of recording paper P to the position of focal point Q by counting the necessary time for recording paper P to move, from the time when recording paper is delivered from paper feed tray 20 by an unillustrated paper feed roller.

However, instead of monitoring fixing controller 612 by a special means, it is also possible to control radiation of laser light based on only the indication signal from controller 600 to radiate laser light.

Figure 8:
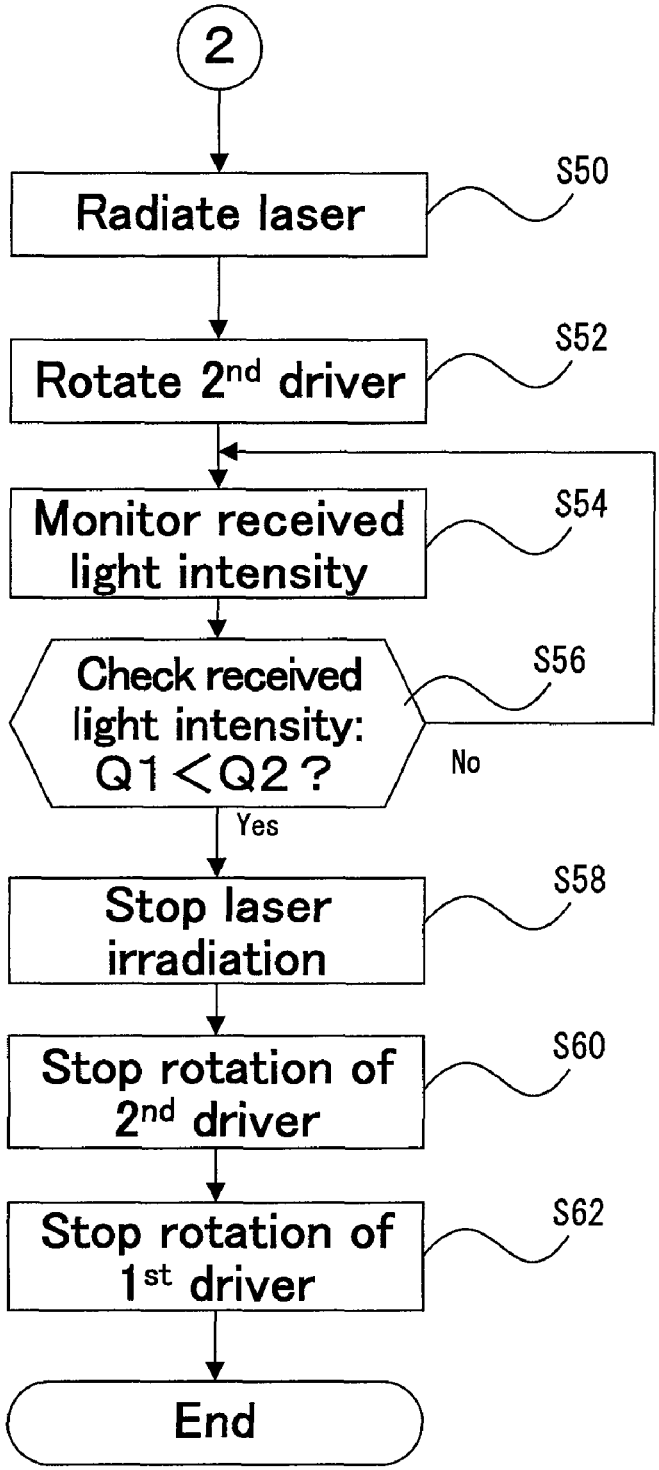

After the end of the printing operation, in order to perform the control of shifting the surface of endless belt 103 off the position of the focal point of laser light from laser light emitter 104, fixing controller 612 gives instructions to control radiation of laser light to laser light emitter 104 (Step S50 in FIG. 8). In this case, as described above, the intensity of irradiation when the focal point of laser light is adjusted to the conveyor surface is different from the intensity of irradiation at the time of fixing. Fixing controller 612 starts rotating the second driver of eccentric cam 112 (Step S52) in order to bring the conveyor surface of endless belt 103 away from the position of the focal point of the laser light. In this operation, controller 600 monitors the intensity of light until the received light intensity Q1 at photo detector 110 downs to a predetermined level (Q2) or lower (Step S54). This value of Q2 is the threshold based on which the conveyor surface of endless belt 103 is determined to be away from the position of the focal point.

Then, when received light intensity Q1 downs to the predetermined level (Q2) or below (Step S56; Yes), radiation of laser light from laser light emitter 104 is stopped (Step S58), rotation of the second driver for eccentric cam 112 is stopped (Step S60) and rotation of the first driver for tension roller 101 is stopped (Step S62).

Variational Examples

As the embodiment of this invention has been detailed with reference to the drawings, the specific configuration is not limited to this embodiment, and designs and others which are within the scope of the invention should be included in the scope of the claims.

When there is a fear that photo detector 110 is broken due to strong radiation of laser light, the operation as follows may be carried out. When the laser emits a strong radiation of light such as to melt the toner during the paper printing operation, half mirror 108 is removed from optical path 114 of laser light by means of a driver in order that photo detector 110 will not receive the reflected light. With this configuration, it is possible to prevent photo detector 110 from being exposed to excessive reception of light and hence prevent photo detector 110 from being broken etc.

Further, the present invention may also be realized by software. That is, the present invention can be achieved by a system including a CPU (central processing unit) for executing commands of control programs for realizing the necessary functions, ROM (read only memory) that stores the program, RAM (random access memory) for developing the programs, and storage devices (storage media) such as memories etc., for storing the program and various pieces of data. Further, the object of the present invention can be achieved by providing a recording medium, on which program codes (exactable code programs, intermediate code programs and source programs) of the control programs as the software for realizing the above functions have been recorded so as to be read out by a computer, to the aforementioned image forming apparatus and causing the computer (or CPU or MPU) to execute the control programs by loading the program codes recorded on the recording medium.

Examples of the aforementioned recording media includes tape type media such as magnetic tape, cassette tape etc., disk type media including magnetic disks such as floppy (trade name) disks, hard disks, etc. optical disks such as CD-ROM, MO, MD, DVD, CD-R, Blue-ray etc., card type media such as IC cards (including memory cards), optical cards, etc., semiconductor memory type media such as mask ROM, EPROM, EEPROM, flush ROM, etc.

When the image forming apparatus is connected to a communication network, the aforementioned program codes may be provided via the communication network. This communication network is not particularly limited. For example, the Internet, intranet, extranet, LAN, ISDN, VAN, CATV communication network, virtual private network, telephone network, mobile communications network, satellite communications network, and the like are available. The transmission medium that constitutes the communication network is not particularly limited. For example, wired lines such as IEEE1394, USB, power-line carrier, cable TV network, telephone line, ADSL line and the like, as well as wireless lines such as infrared access including IrDA and remote control, Bluetooth (trade name), 802.11 wireless access, HDR, mobile telephone network, satellite line, digital terrestrial network and the like, are available. The present invention can also be realized by the form of computer data signals embedded in the carrier wave that embodies electronic transmission of the above program codes.

What is claimed is:

1. A fixing device comprising:

a controller that makes such control as to pass recording paper through the position of the focal point of laser light and bring the surface of an endless belt for conveying recording paper away from the position of the focal point of the laser light when conveyance of the recording paper is stopped, wherein an unfixed toner image formed on the recording paper that is conveyed by the endless belt is irradiated with laser light so as to fuse the toner and fix the toner image, and wherein the controller changes the intensity of laser irradiation between when the unfixed toner image is fixed and when the position of the recording paper conveyor surface of the endless belt is detected.

2. The fixing device according to claim 1, wherein the controller makes such control as to bring the conveyor surface away from the position of the focal point of the laser light, based on the detection signal obtained by a photo detector detecting the reflected light of the laser light that is radiated on the recording paper conveyor surface of the endless belt.

3. The fixing device according to claim 1, further comprising a movable part for moving the endless belt in a vertical direction.

4. An image forming apparatus including the fixing device according to claim 1.

5. A non-transitory computer-readable recording medium on which a control program for operating the fixing device according to claim 1, to cause a computer to function as the controller, is recorded.

6. A control method of a fixing device that includes:

a laser light emitter for fixing an unfixed toner image;

a recording paper conveyor for conveying recording paper by means of an endless belt;

a movable part for moving the recording paper conveyor in a vertical direction; and, a photo detector for detecting the surface position of the recording paper and the surface position of the endless belt by use of the reflected light of the laser light, wherein the movable part is controlled based on the detected result from the photo detector; the method comprising:

changing the intensity of laser irradiation between when the unfixed toner image is fixed and when a position of a recording paper conveyor surface of the endless belt is detected.

* * * * *